United States Patent [19]

Stoll

[11] 4,027,818

[45] June 7, 1977

[54] SELF LOCKING CONTAINER

[75] Inventor: Mark Steven Stoll, Minneapolis, Minn.

[73] Assignee: Liberty Carton Co., Minneapolis, Minn.

[22] Filed: Dec. 18, 1975

[21] Appl. No.: 642,150

[52] U.S. Cl. ..... 229/37 R

[51] Int. Cl.[2] ..... B65D 5/22; B65D 5/02

[58] Field of Search ..... 229/37 R, 39, 34 R, 229/41 B

[56] References Cited

UNITED STATES PATENTS

| | | | |
|---|---|---|---|
| 2,348,378 | 5/1944 | Goodyear | 229/37 R |
| 3,002,672 | 10/1961 | Kotowick | 229/37 R X |
| 3,016,180 | 1/1962 | Struble | 229/37 R |
| 3,366,308 | 1/1968 | Phillips, Jr. | 229/41 B |
| 3,473,722 | 10/1969 | Rohde | 229/37 R |
| 3,501,081 | 3/1970 | Paige | 229/37 R X |
| 3,529,763 | 9/1970 | Wagner | 229/37 R |
| 3,565,325 | 2/1971 | Pugsley | 229/37 R |
| 3,750,932 | 8/1973 | Ellison | 229/37 R |
| 3,889,868 | 7/1975 | Bruckner et al. | 229/34 R |

OTHER PUBLICATIONS

IBM Tech. Disclosure Bulletin, vol. 15, No. 9, 9 Feb., 1973, pp. 2734 & 2735.

*Primary Examiner*—Davis T. Moorhead
*Attorney, Agent, or Firm*—Williamson, Bains & Moore

[57] ABSTRACT

A container of generally rectangular shape is formed with a self-locking bottom wall from a single blank of cut and scored fiberboard material. A pair of bottom panels fold inwardly and upwardly from the bottom edges of one pair of side walls to form the bottom of the container; and a pair of reinforcing panels simultaneously fold inwardly to upright, strengthening positions against the inside faces of the other pair of side walls. The interconnected bottom and reinforcing panels are locked in place by hold down flaps folded downwardly from the reinforced side walls over the reinforcing panels.

5 Claims, 6 Drawing Figures

SELF LOCKING CONTAINER

BACKGROUND OF THE INVENTION

Among the great variety of fiberboard containers which have been designed for assembly from knocked down condition, none has proven to be truly satisfactory for reusable service as a shipping container. A measure of success has been achieved in strengthening the side walls of such containers by the use of multiple panels folded into place. See, for example, U.S. Pat. No. 3,889,868 assigned to Liberty Carton Co., the assignee hereof. However, the multiple requirements of wear resistance, strength and quick and easy assembly for repeated use from a knocked down condition have not heretofore been met in a single container. The container disclosed herein has been developed to meet such requirements.

BRIEF SUMMARY OF THE INVENTION

The container of this invention is particularly characterized by a simple, self-locking bottom wall assembly formed from a single blank of cut and scored fiberboard in such a way as to provide a reinforced container having exceptional side wall strength. The container so constructed is particularly well suited for repeated, rough handling in shipping service, and can be quickly collapsed to a flat, knocked down position for storage.

These basic objectives are realized by forming the bottom wall of the fiberboard container from a pair of panels hingedly attached to the bottom, longitudinal edges of one opposed pair of the container side walls, and providing a pair of reinforcing panels hingedly attached to the bottom, longitudinal edges of the other pair of opposed side walls. The bottom and reinforcing panels are so cut and arranged along fold lines on a single blank of fiberboard as to be foldable upwardly and inwardly from downwardly extended open positions to assembled positions wherein the bottom panels are horizontal and form the container bottom wall and the reinforcing panels fold inside of the bottom panels to upright positions in overlying, supporting relation to one pair of the container side walls.

Preferably, the aforesaid bottom panels and reinforcing panels are interconnected along fold lines where they intersect adjacent the corners formed by the container side walls. Gusseting of the reinforcing panels along angled score lines permits them to collapse and fold upwardly to an essentially triangular shape against one pair of side walls, as the bottom panels are folded inwardly to their closed position.

The reinforcing panels are secured in their upright support positions, and the bottom assembly is locked in place by a pair of hold down flaps hingedly attached to the reinforced side walls along fold line connections with the top longitudinal edges thereof. These hold down flaps are folded inwardly and downwardly over the reinforcing panels, and are held in place by friction fit, retention portions thereof.

Preferably, the top of the container is closed by a pair of interlocking cover flaps hingedly attached to the top, longitudinal edges of the opposed pair of side walls to which the bottom panels are also hingedly connected.

These and other objects and advantages of my invention will become readily apparent as the following description is read in conjunction with the accompanying drawings wherein like reference numerals have been used to designate like elements throughout the several views.

DESCRIPTION OF THE PREFERRED EMBODIMENT

Figure 1:
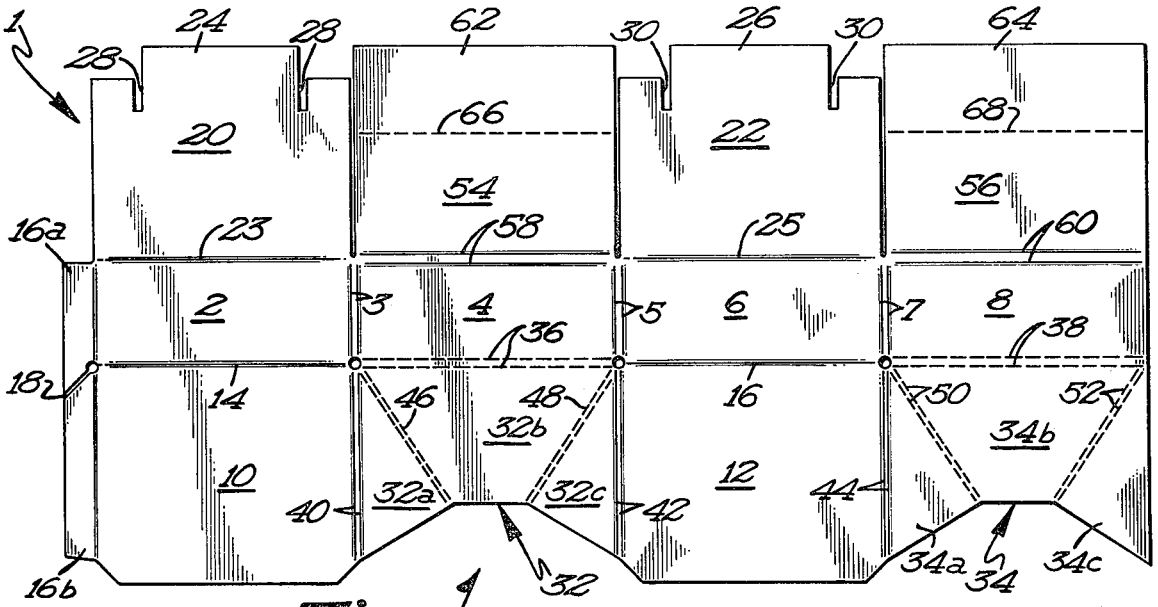
FIG. 1 is a top, plan view of the fiberboard blank from which the container of this invention is formed and assembled.

I have shown in FIG. 1 a fiberboard blank cut and scored in a particular way to permit a rectangular container to be formed therefrom by folding steps so as to provide a particularly secure bottom and reinforced side walls. The fiberboard blank is generally identified by reference numeral 1. The panels designated by reference numerals 2, 4, 6 and 8 define the side walls of the container and are interconnected along scored fold lines 3, 5 and 7. Bottom panels 10 and 12, which form the bottom wall of the container, are connected along fold lines 14 and 16 with side wall panels 2 and 6 respectively. Glue flaps 16a and 16b, separated by a cut slot 18 are hingedly attached to the free ends of side wall panel 2 and bottom panel 10 as shown in FIG. 1. These glue flaps are utilized to secure the fiberboard blank in a generally rectangular shape in the manner set forth below.

Top closure panels 20 and 22 are hingedly secured to the top, longitudinal edges of side wall panels 2 and 6 along fold line connections 23 and 25 therewith. Outwardly extending lock tongues 24 and 26 are formed on the outer, free ends of top closure panels 20 and 22. These lock tongues are defined by spaced pairs of slots 28 and 30 formed in closure panels 20 and 22 as shown in FIG. 1.

For the purpose of reinforcing the side walls of the container, and adding stacking strength, a pair of reinforcing panels generally indicated by reference numerals 32 and 34 are provided. These panels are hingedly connected along score lines 36 and 38 respectively to the bottom, longitudinal edges of the other pair of opposed side wall panels 4 and 6. Fold line connections 36 and 38 between side walls panels 4, 8 and reinforcing panels 36, 38, respectively, are double scored to facilitate folding and forming of the container. It is also to be noted that reinforcing panels 32 and 34 are connected to bottom panel 10 and 12 along double scored, fold line connections 40, 42 and 44 therewith. Reinforcing panel 32 is gusseted by a pair of score lines 46 and 48 angling downwardly and inwardly towards each other from the opposite ends of the fold line connection 36 between side wall panel 4 and reinforcing panel 32. It is to be noted that the directional orientation of score lines 46, 48 as well as the description of reinforcing panels 32 and 34 as being attached to the bottom longitudinal edges of side wall panels 4 and 8 is to be understood in the context of the intermediate position of assembly of the container shown in FIG. 2 wherein the side walls are oriented vertically with bottom panels 10, 12 and reinforcing panels 32, 34 depending downwardly therefrom. Score lines 46, 48 divide reinforcing panel 32 into three interconnected panel segments 32*a*, 32*b* and 32*c*. Central panel 32*b* will assume the truncated, triangular shape shown for the particular size of container illustrated herein. The other reinforcing panel 34 is also gusseted by a pair of similarly oriented score lines 50 and 52 which divide reinforcing panel 34 into three interconnected panel segments 34a, 34b and 34c, shaped as shown.

For reasons hereinafter explained, a pair of hold down flaps 54 and 56 are hingedly attached to the top, longitudinal edges of side wall panels 4 and 8 along fold line connections 58 and 60 therewith. Fold line connections 58 and 60 are also preferably double scored to facilitate the folding of flaps 54 and 56 to their fully assembled positions. Flap segments 62 and 64 are formed as extensions of hold down flaps 54 and 56 on the outer ends thereof. Crease lines 66 and 68 permit the folding of flap segments 62 and 64 with respect to hold down flaps 54 and 56 as hereinafter set forth.

Figure 2:
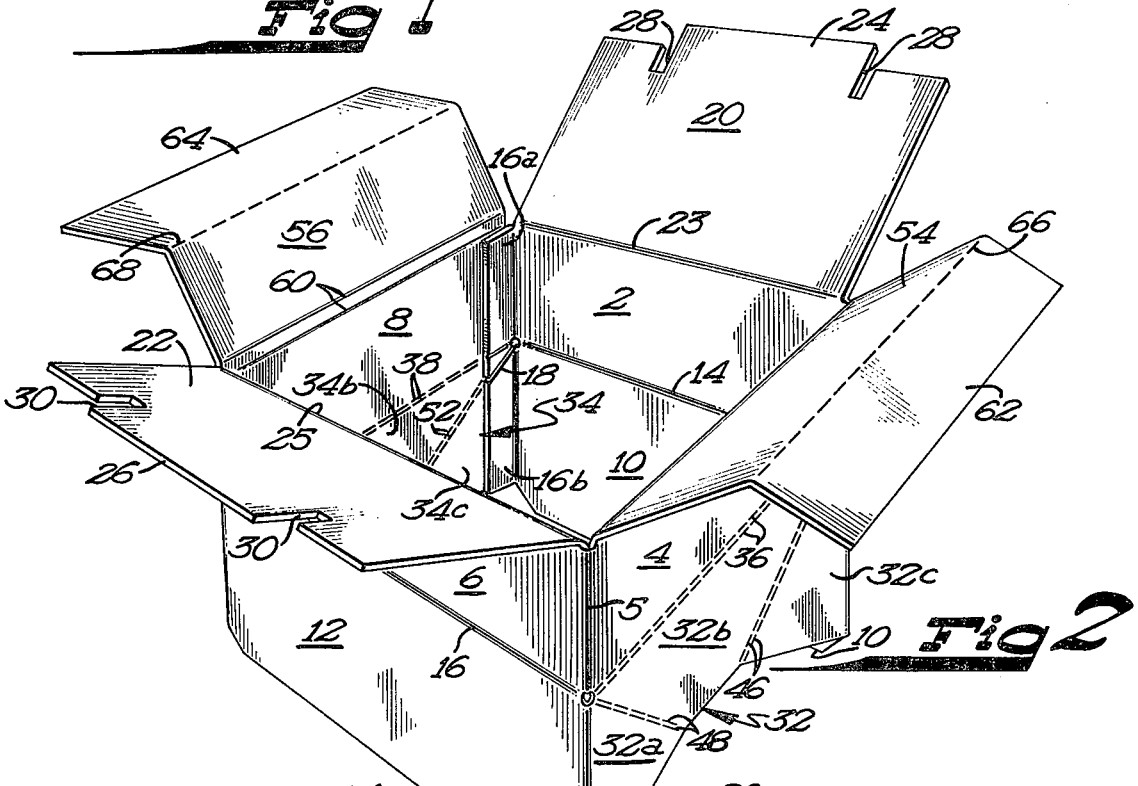
FIG. 2 is a top, perspective view of the container of this invention in a partially assembled state.

In the process of assembling the container, the fiberboard blank 1 is first oriented in an upright position. Side wall panels 2, 4, 6 and 8 are then folded along score lines 3, 5 and 7 to arrange the side walls in a substantially rectangular configuration. As is indicated in FIG. 2, the side walls are maintained in this position by gluing flaps 16a and 16b to the adjacent, inside faces of side wall 8 and panel segment 54c of reinforcing panel 34. This joint is formed at the corner of the container between side walls 2 and 8, and may obviously be achieved by alternative securing means, such as, staples. With glue glaps 16a and 16b secured in position as shown in FIG. 2, the container will be held in a substantially rectangular configuration. At this stage, bottom panels 10, 12 and reinforcing panels 32, 34 will be oriented substantially vertically in downwardly extending positions with respect to the side wall panels 2, 4, 6 and 8 to which they are attached. At this intermediate stage of assembly, the fold line connections between bottom panels 10, 12 and reinforcing panels 32, 34 are substantially in vertical alignment with the fold line connections between side walls 2, 4, 6 and 8 at the corners of the container. For example, fold line connection 42 between bottom panel 12 and reinforcing panel 32 will be in alignment with fold line connection 5 between side panels 4 and 6.

Figure 3:
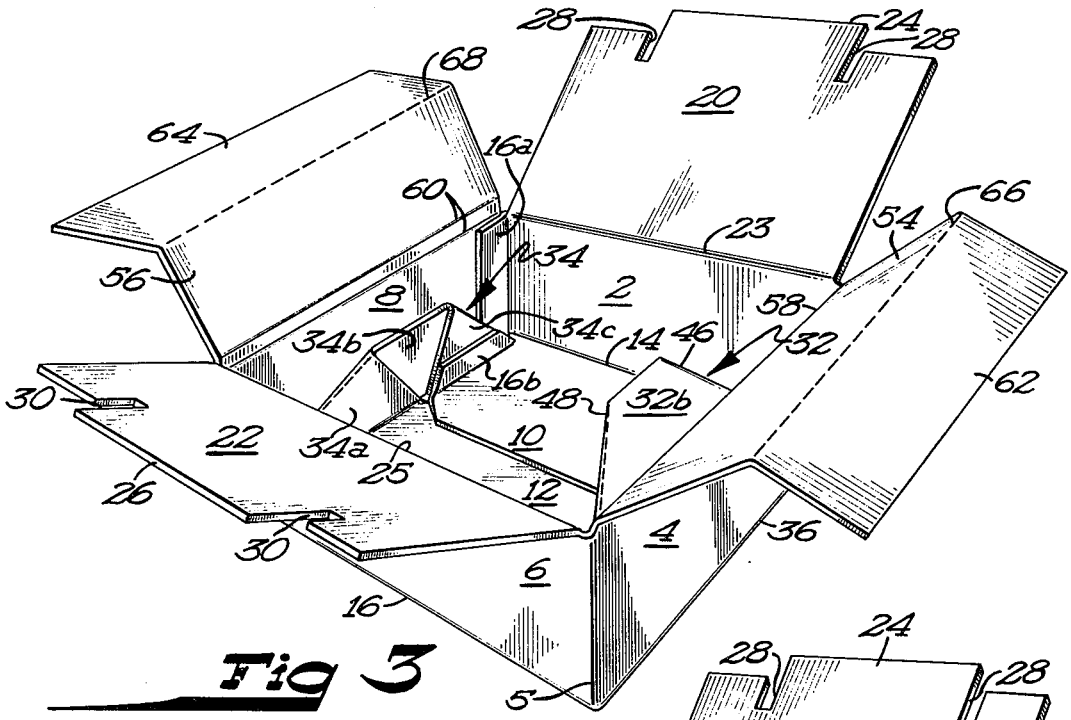
FIG. 3 is a perspective view of the container, similar to FIG. 2, and showing the bottom panels of the container folded to their closed positions with a pair of reinforcing panels in an intermediate stage of assembly.

With the partially assembled container in the upright position shown in FIG. 2, the bottom of the container is closed by folding bottom panels 10 and 12 upwardly and inwardly from their downwardly extended, open positions, along their fold line connections 14 and 16 with side walls 2 and 6. FIG. 3 shows bottom panels 10 and 12 folded upwardly to a substantially horizontal position wherein they close the bottom of the container. The inner edges of bottom panels 10 and 12 may overlap, as shown, or may abut against each other. Because reinforcing panels 32 and 34 are connected to bottom panels 10 and 12 along fold line connections 40, 42 and 44 therewith, reinforcing panels 32 and 34 will unavoidably be carried upwardly and inwardly by the upward, closing movement of bottom panels 10 and 12. As this happens, reinforcing panels 32 and 34 collapse along their gusseted score lines 46, 48 and 50, 52. As a result, reinforcing panels 32 and 34 are folded to the generally triangular shape shown in FIG. 3. Wing panel segments 32*a*, 32*c* and 34*a*, 34*c* collapse under the central, triangular segments 32*b* and 34*b* as they are folded upwardly. Reinforcing panels 32 and 34 swing upwardly inside of bottom panels 10 and 12, as the bottom panels are folded upwardly and inwardly. In FIG. 3 reinforcing panel 34 is shown in its final position of assembly wherein it is folded upwardly and inwardly to a substantially upright position against the inside face of sidewall 8. Reinforcing panel 32 is ultimately folded to a similar, upright position in overlying relation against the inside face of sidewall 4.

Figure 4:
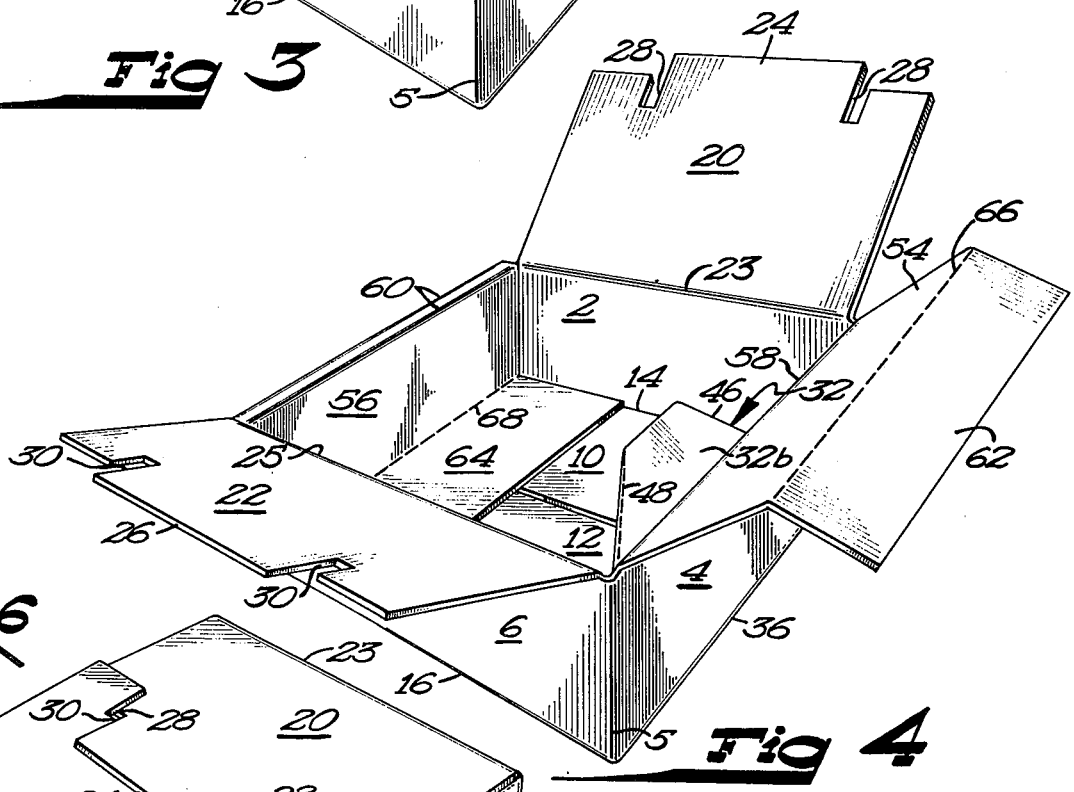
FIG. 4 is a perspective view similar to FIGS. 2 and 3 and showing a hold down flap folded into place over one of the upright reinforcing panels.

Hold down flaps 54 and 56 serve to hold reinforcing panels 32 and 34 in their upright, reinforcing positions against side walls 4 and 8. This is accomplished by folding hold down flaps 54 and 56 inwardly and downwardly in overlying relation to reinforcing panels 32, 34 along their fold line connections 58 and 60 with the top edges of side walls 4 and 8. FIG. 4 shows hold down flap 56 folded inwardly in such a manner to its final retention position in overlying relation to reinforcing panel 32 in generally parallel, coextensive relation to side wall 8. Hold down flap 54 is folded inwardly over reinforcing panel 32 in a similar manner. Thus, reinforcing panels 32 and 34 are sandwiched between hold down flaps 54, 56 and side walls 4 and 8.

Various types of retention means could be utilized to secure hold down flaps 54 and 56 in their inwardly folded, locking positions over reinforcing panels 32 and 34. For example, lock tab extensions could be utilized along the bottom edges of hold down flaps 54 and 56 and inserted within slots provided in bottom panels 10 and 12 adjacent the bottom edges of side walls 4 and 8. However, I have found it desirable and effective to utilize a pair of flap segment extensions 62 and 64 on the outer ends of hold down flaps 54 and 56 as retention means. As is indicated with respect to retention flap segment 64 in FIG. 4, flaps 62 and 64 are folded along their crease lines 66 and 68 to substantially horizontal positions as hold down flaps 54 and 56 are folded inwardly. Retention flaps 62 and 64 assume a horizontal, flat position against bottom wall panels 10 and 12. Retention flaps 62 and 64 are of a predetermined length which will permit their snug, friction fit between opposed side walls 2 and 6. This friction fit of retention flaps 62 and 64 against side walls 2 and 6 ensures that hold down flaps 54 and 56 will remain securely in a locked position overlying reinforcing panels 32 and 34. It will be appreciated that since reinforcing panels 32 and 34 are interconnected with bottom panels 10 and 12, the locking of reinforcing panels 32 and 34 against side walls 4 and 8 by means of hold down flaps 54, 56 and retention flaps 62 and 64 simultaneously secures bottom panels 10 and 12 against downward movement to an open position. Thus, a self-locking bottom assembly is provided by the particular, interconnected arrangement of bottom panels, reinforcing panels and hold down flaps folded to an assembled position as described herein.

This secure locking of the bottom of the container, without the need of any staples, glue or tape or other holding devices of any kind, overcomes one of the serious problems encountered with prior art shipping containers. The container disclosed herein can be used many times by simply collapsing it to a flat position by opening the hold down flaps 54, 56 and pushing bottom walls 10, 12 downwardly and outwardly. When the container is to be reused, it can be closed again to its fully assembled position by simply pulling bottom panels 10 and 12 upwardly and inwardly. As noted above, this action simultaneously folds reinforcing panels 32, 34 inwardly with hold down flaps 54 and 56 being closed inwardly again to secure reinforcing panels 32, 34 in upright, supporting positions against side walls 4 and 8. The secure engagement of reinforcing panels 32, 34 against side walls 4 and 8 strengthens the side walls and lends considerable stacking strength to the container. This is important in avoiding damage to the containers when they are stacked in a loaded condition during shipping and handling.

Figure 6:
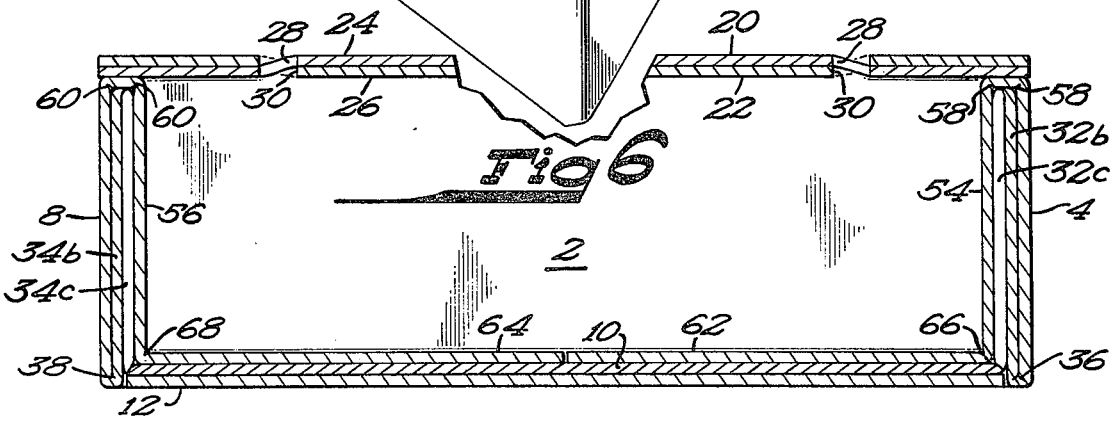
FIG. 6 is a vertical section view of the container taken along lines 6—6 of FIG. 5.
Figure 5:
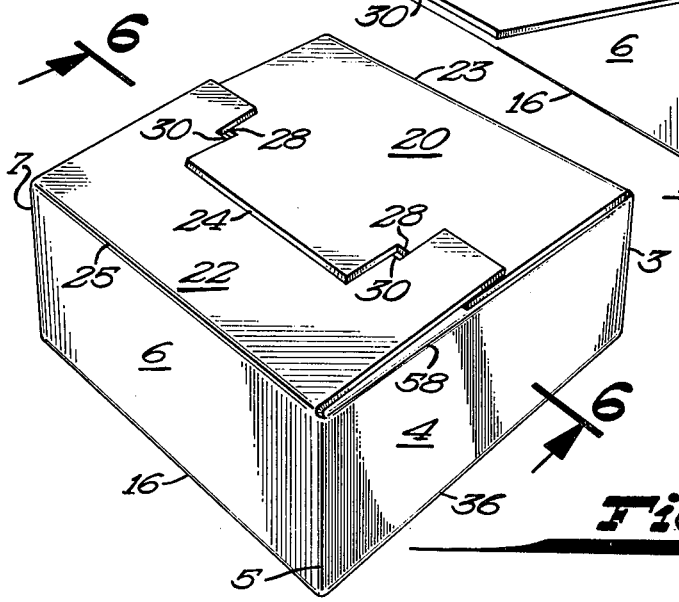
FIG. 5 is a perspective view of the fully assembled container, with the top, cover panels closed.

After being assembled in the aforesaid manner, the container is closed by swinging cover panels 20 and 22 inwardly towards each other along their fold line connections 23 and 25 with the top edges of side walls 2 and 6. Cover panels 20 and 22 are secured together in a closed position in covering relation to the container over the bottom wall defined by panels 10, 12. This is preferably accomplished by engaging lock tongues 24, 26 along their mating, complementary slots 28 and 30 on each side thereof. FIG. 5 shows the container fully assembled with top cover panels 20 and 22 closed and engaged in the aforesaid manner. This top closure arrangement as well as the final position of the reinforcing panels 32 and 34 along side walls 4 and 8 is also clearly illustrated in the section view of FIG. 6. Reference is also made to FIG. 6 for a clear showing of the manner in which reinforcing panels 32 and 34 are sandwiched in an upright position between hold down flaps 54, 56 and end walls 4 and 8. This manner of construction and assembly of the container not only lends strength and rigidity to the side walls 4 and 8, but also reinforces the bottom of the container through the overlying engagement of retention flaps 62 and 64 with bottom panels 10 and 12. In the preferred embodiment shown, retention flaps 62 and 64 are of such a length as to cover substantially the entire bottom of the container. Shorter retention flaps 62 and 64 could be utilized, if desired.

I contemplate that the container disclosed herein will find particular utility in the handling of light loads that will fill the entire container bottom area, and thus be supported around the strong peripheral strength area of the box along reinforced side walls 4 and 8. For example, this container has been proven to be particularly effective and useful in the packing and handling of meat products, and light snacks, such as, potato chips. The assembly procedure described above permits the container to be quickly and easily assembled from a flat, knocked down condition to a fully assembled condition for packing. After use, the container can be partially disassembled by simply pushing bottom panels 10, 12 outwardly and downwardly, and reinforcing panels 32, 34 therewith, and then flattening the container. The resistance to wear, and increased stacking strength realized by reinforcing panels 32 and 34 permits repeated use of the container without substantial damage.

The particular configuration of reinforcing panels 32, 34 may vary somewhat depending upon the particular dimensions and relative panel sizes of the container. For example, if the depth of the container as defined by the height of the side walls is over one-half of the width, then reinforcing panels 32, 34 would not be cut out as shown in FIG. 1 along the bottom ends, and panel segments **32*b* and 34*b* thereof could be of a full, triangular shape. With such a configuration, gusseted score lines 46, 48 and 50, 52 would extend fully over the whole length of full panels 32, 34 to an apex where they would meet. Such fully triangular shaped reinforcing panel segments 32*b* and 34*b* would not extend over the full height of the container side walls as do truncated, triangular shaped panel segments 32*b* and 34*b*, as illustrated in FIG. 6.** I anticipate that various other changes may be made in the size, shape and configuration of the container disclosed herein, without departing from the spirit and scope of my invention as defined by the following claims.

What is claimed is:

1. A container formed from cut and scored, bendable fiberboard comprising:

four upright side walls joined together in a substantially rectangular configuration;

a pair of opposed bottom panels hingedly attached to the bottom, longitudinal edges of one opposed pair of said side walls along fold line connections therewith, said bottom panels being folded upwardly and inwardly towards each other to horizontal positions defining the bottom wall of said container;

a pair of reinforcing panels hingedly attached to the bottom, longitudinal edges of the other pair of opposed side walls along fold line connections therewith, said reinforcing panels being folded upwardly and inwardly inside of said bottom panels to substantially upright positions in overlying relation against the inside faces of the other pair of side walls in supporting relation therewith;

said reinforcing panels are attached along fold line connections to said bottom panels at the corners of said container and are each gusseted by a pair of score lines angling inwardly and downwardly towards each other from the opposite ends of the bottom longitudinal edges of said other pair of side walls, when said reinforcing panels are in a downwardly extended, open position, whereby the upward and inward folding movement of said bottom panels from downwardly extended, open positions to their closed positions forming said bottom wall carries said interconnected reinforcing panels upwardly and inwardly therewith to collapsed positions of triangular-like shape in which said reinforcing panels are held in upright, overlying relation to said other pair of side walls; and means securing said reinforcing panels in said upright positions against said other pair of side walls.

2. A container as defined in claim 1 wherein:

said means for securing said reinforcing panels in said upright positions comprises a pair of hold down flaps hingedly attached to said other pair of side walls along fold line connections with the top, longitudinal edges thereof, said hold down flaps being folded inwardly in overlying relation to said reinforcing panels in generally parallel, coextensive relation to said other pair of side walls; and retention means holding said hold down flaps in said inwardly folded position.

3. A container as defined in claim 2 wherein:

said retention means comprises a pair of flap segments hingedly attached to the outer, longitudinal edges of said hold down flaps and folded inwardly to horizontally extended positions flattened against said bottom wall with their side edges in a snug, friction fit with said one, opposed pair of side walls.

4. A container as defined in claim 2, and further including:

a top closure for said container comprising a pair of cover panels hingedly attached to the top, longitudinal edges of said one pair of opposed side walls and folded inwardly towards each other in a closed position in overlying relation to the container bottom wall; and means securing said cover panels together in said closed position.

5. A container as defined in claim 1 wherein:

said bottom panels overlap and interlock along their inner ends to form a continuous bottom wall on said container.

* * * * *